US006652356B1

(12) United States Patent
Ariga

(10) Patent No.: US 6,652,356 B1
(45) Date of Patent: Nov. 25, 2003

(54) WIRE SAW AND CUTTING METHOD

(75) Inventor: Yasuharu Ariga, Nishishirakawa-gun (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/623,921

(22) PCT Filed: Jan. 14, 2000

(86) PCT No.: PCT/JP00/00155

§ 371 (c)(1),
(2), (4) Date: Sep. 11, 2000

(87) PCT Pub. No.: WO00/43162

PCT Pub. Date: Jul. 27, 2000

(30) Foreign Application Priority Data

Jan. 20, 1999 (JP) ..... 11-11680

(51) Int. Cl.[7] ..... B24B 49/14; B28D 1/08
(52) U.S. Cl. ..... 451/7; 125/16.02
(58) Field of Search ..... 125/16.02, 16.01, 125/35; 451/164, 53, 7, 488, 449

(56) References Cited

U.S. PATENT DOCUMENTS 5,201,305 A * 4/1993 Takeuchi ..... 125/16.02
5,269,285 A * 12/1993 Toyama et al. ..... 125/16.02
5,377,568 A * 1/1995 Hauser ..... 83/74
5,827,113 A * 10/1998 Okuno et al. ..... 125/23.01

FOREIGN PATENT DOCUMENTS

| | | |
|---|---|---|
| JP | 7-1442 | 1/1995 |
| JP | 10-138231 | 5/1998 |
| JP | 11-58365 | 3/1999 |
| JP | 11-221748 | 8/1999 |

* cited by examiner

*Primary Examiner*—Robert A. Rose
(74) *Attorney, Agent, or Firm*—Oliff & Berridge, PLC

(57) ABSTRACT

There is provided a cutting method comprising winding a wire around plural grooved rollers, and pressing the wire against the work with running it, to cut the work, wherein the work is cut with controlling temperature of the work by supplying a cutting fluid containing abrasive grains to the grooved rollers, and supplying a temperature controlling medium to the work and a wire saw. Thereby, influence of the heat generated during cutting process of the work is controlled, and a relative shift of the work and the wire can be suppressed, a level of a warp of a wafer and a local warp can be improved, and flatness in a polishing step can be improved.

9 Claims, 4 Drawing Sheets

WIRE SAW AND CUTTING METHOD

BACKGROUND OF THE INVENTION

1. Field of the Invention

The present invention relates to a wire saw for cutting out many wafers from a work such as a columnar semiconductor ingot, ceramics, glass or the like, and a cutting method using it.

2. Description of the Related Art

Recently, wafers have been required to be large, and highly flat. In order to cope with the large wafer, a wire saw have been mainly used for cutting of an ingot.

A wire saw is an apparatus for cutting many wafers at the same time by a grinding action comprising pressing the work against wires provided with a predetermined pitch, and moving the wire and the work relatively with pouring a cutting fluid containing abrasive grains.

Advantages of the wire saw are that it can cut many wafers at the same time, and thus productivity is high, and that it can produce cut wafers having the approximately same shape owing to simultaneous cutting.

Disadvantage of the wire saw is that a warp (sori) of the cut wafer is large. As a conventional method to solve the problem, there has been adopted a method comprising controlling a temperature of a bearing part of a grooved roller on which the wire is wound to suppress thermal expansion of the roller due to frictional heat during cutting or the like, and thereby the problem of the warp has been solved to some extent.

More specifically, in wire saw frictional heat is generated when the work is pressed against the wire, so that the temperature not only of the work, but also of the working room is increased. If the temperature gets high during cutting, not only the work, but also a part of an apparatus such as a working table is also thermally expanded. As a result, relative position of the work and the apparatus are shifted, and the shape thereof is transcribed to the work as a warp of the wafer.

The conventional method for solving the problem comprises decreasing an influence of increased temperature by applying a cooling medium to a main part of the apparatus such as a bearing, housing or the like. However, there is no means against heat at a part where the work is processed, which is a source of generation of heat, As a result, change in temperature during processing cannot be controlled.

The heat generated during cutting process depends on length of the arc vertical to the direction of cutting (length of the wire that is in contact with the work; cutting length). The change in the length of the arc is large against the direction of cutting. Accordingly, the temperature is significantly changed for a short time after initiation of the cutting, and thus relative shift of the position of the work and the apparatus gets large. The same phenomenon also occurs just before the end of the cutting. Accordingly, the shape having locally large warp formed at the early stage and the terminating stage of the cutting of the wafer (see FIG. 5).

The warp formed during cutting cannot be corrected in the following steps such as lapping, etching or the like, and kept to the end. It has been confirmed that such a warp that is locally large affects flatness during a polishing step.

SUMMARY OF THE INVENTION

The present invention has been accomplished to solve the above-mentioned problems, and a main object of the present invention is to provide a method of cutting an ingot and an apparatus therefor wherein a relative shift of the work and the wire is suppressed, a level of a warp of a wafer and a local warp can be improved, and flatness in a polishing step can be improved.

To solve the above-mentioned problems, the present invention is a cutting method comprising winding a wire around plural grooved rollers, and pressing the wire against the work with running it, to cut the work, wherein the work is cut with controlling temperature of the work by supplying a cutting fluid containing abrasive grains to the grooved rollers, and supplying a temperature controlling medium to the work.

As described above, when the work is cut with supplying a cutting fluid containing abrasive grains to the grooved rollers, and supplying a temperature controlling medium to the work, increase of temperature of the work due to the heat generated during cutting of the work can be suppressed to be slow, and the temperature can be kept at a desired value or lower. Accordingly, a level of a warp on the section of the work, a local warp, waviness of all over the work can be improved, and flatness in the following polishing process can be significantly improved. Thereby, productivity and yield of a semiconductor silicon wafer can be improved, and cost performance can also be improved.

The present invention is also a cutting method comprising winding a wire around plural grooved rollers, and pressing the wire against the work with running it, to cut the work, wherein a temperature of the work is previously defined at a predetermined value, and the work is cut with supplying a cutting fluid containing abrasive grains to the grooved rollers.

The method comprises preheating the work to a predetermined temperature before cutting of the work, and then initiating the cutting to cut the work with supplying a cutting fluid containing abrasive grains to the grooved rollers. Thereby, change in temperature of the work, especially at the early stage of the cutting can be made gentle, a level of the warp of the cut surface and a local warp can be significantly improved. If the temperature of the work is increased as described above, it is also advantageous for the reason that the work is hardly affected by external temperature such as room temperature, temperature of the mechanical part of the apparatus or the like.

A method for preheating the work to the predetermined temperature is, for example, a method of preheating the work outside the apparatus, for example using an oven or the like before the work is set in the wire saw, and then set the work therein. Alternatively, there can be adopted the method comprising installing a heater to a plate for holding a work, and heating the work set therein, the method of supplying a temperature controlling medium such as a cutting fluid or air, or the like, controlled in a predetermined temperature to the work and preheating it before cutting.

The present invention is also a cutting method comprising winding a wire around plural grooved rollers, and pressing the wire against the work with running it, to cut the work wherein a temperature of the work is previously defined at a predetermined temperature, and the work is cut with controlling a temperature of the work by supplying a cutting fluid to the grooved rollers, and supplying a temperature controlling medium to the work.

Thereby, the change in temperature of the work in the early stage can be suppressed to be gentle, and increase in the temperature of the work in a period from the middle to the terminating stages of the cutting process can be further suppressed. Accordingly, a local warp generated in the early stages or terminating stages of the cutting process can be made small, and waviness of the whole work and flatness thereof after polishing can be improved significantly.

In that case, change in temperature of the work in a period from the beginning of the cutting process to the time when a cutting length reaches 60% of a diameter of the work and/or in a period from the time when a cutting length reaches 60% of a diameter of the work to the end of the cutting process in the latter half of the cutting is controlled to be 10° C. or less.

For example, in the case that the work having a diameter of 8 inches is cut, and the temperature of the work before cutting is about 25° C., the cutting length reaches 60% of a diameter when the cutting length in a direction of the diameter is 20 mm after cutting is initiated. Accordingly, the change in temperature of the work in the period should be controlled to be 10° C. or less. Namely, the temperature of the wafer at the early stages of the cutting process should be controlled to be 35° C. or lower. As described above, when the change in temperature of the work is controlled so as not to be large, especially at the early stages of the cutting process, difference in thermal expansion between the work and the wire saw can be small, and thus extreme change in a shape of the warp does not occur, so that the warp can be made small. In the case that the work having a diameter of 12 inches is cut, the cutting length reach 60% of a diameter when the cutting length in a direction of the diameter is about 30 mm after cutting is initiated. Accordingly, the change in temperature of the work in the period should be actively controlled to be gentle.

In the case that the work having a diameter of 8 inches is cut, the change in temperature of the work is preferably controlled to be 10° C. or less in the period until the end of the cutting process after the cutting length reaches 60% of a diameter of the work, namely after the remaining cutting length is about 20 mm, since the warp can be made small as in the early stages of a cutting process.

As described above, it is preferable to make change in temperature of the work gentle in the early stages and in the terminating stages, since change in temperature during cutting can be suppressed thereby.

In that case, the temperature of the work can be predetermined so that a shape of the warp of the wafer defined by simulation with coefficient of linear expansion and temperature of each part of the work and the wire saw can be flat.

As described above, it is simple and convenient that the temperature of the work to be controlled during a cutting process is defined by simulation. In the present invention, the data as for the warp obtained by the simulation are well consistent with the actual data.

In that case, the above-mentioned temperature controlling medium can be a cutting fluid of which temperature is controlled and/or an air of which temperature is controlled.

As described above, the temperature of the work can be controlled by directly pouring a cutting fluid of which temperature is controlled to be the constant value as a temperature controlling medium to the work, or by spraying an air of which temperature controlled to be the predetermined value to the work. It is especially simple and preferable to supply a cutting fluid to the work, since a structure of an apparatus can be simple, and a fluid after cutting can be easily collected. It is also possible to use both of the method of pouring a cutting fluid and the method of spraying air.

The temperature of the work during cutting is preferably kept lower than 35° C.

As described above, if the work is cut with supplying a cutting fluid containing abrasive grains of which temperature is, for example, about 25° C. to grooved rollers, and with supplying a temperature controlling medium of which temperature is controlled directly to the work so that temperature of the work during cutting can be kept at lower than 35° C., the temperature of heat generated at the cutting part can be suppressed, thermal expansion of the wire saw and the work can be made small, a shift of the relative position between the work and the wire is also small. As a result, level of a warp on the cut surface of the work, a local warp formed in the early stage or the like, waviness that is a shape of the whole work, and flatness can be improved. Particularly, if the temperature controlling medium is supplied directly to the work, the temperature of the work can be controlled accurately and easily. The temperature of 35° C. to which the work should be controlled during cutting is defined according to the above-mentioned simulation.

It is desirable to control the temperature of the plate part for supporting the work.

If the temperature of the plate part for supporting the work is controlled, and the temperature of the work is indirectly controlled, distortion such as expansion or the like of the plate part can be suppressed. Such a method is further effective to improve the warp of the work.

The present invention is a wire saw wherein a wire is wound around plural grooved rollers, and a work is cut by pressing the wire against the work with running the wire, comprising a means for supplying a cutting fluid containing abrasive grains of which temperature is controlled to the grooved rollers, a means for pouring a cutting fluid containing abrasive grains of which temperature is controlled directly to the work or a means for spraying a medium, especially air of which temperature is controlled directly to the work.

If the wire saw has such a constitution, temperature of the heat generated through a cutting process from initiation to the end thereof can be kept low, change during cutting due to thermal expansion of a work or a wire saw gets small, and a semiconductor wafer wherein a warp can be kept small and approximately constant can be provided by the wire saw.

In that case, the above-mentioned wire saw can be equipped with a temperature controlling means at a plate part for supporting the work. Namely, a temperature controlling means such as a heater, a heat exchanger or the like can be provided at the plate part to conduct heating and cooling.

If the wire saw is constituted as described above, and the temperature of the plate part itself supporting for the work is controlled, a deviation due to thermal expansion at the plate part can be prevented, further high cutting accuracy can be achieved, so that the wire saw can provide a work having further small warp. It can also be used as a means for preheating a work.

As described above, according to the present invention, difference in thermal expansion between a work and a wire saw becomes small, extreme change in the shape in the early stage of the cutting process can be prevented, the warp can be made small, and thus a wafer having a desired shape of a warp can be cut out. Accordingly, flatness is hardly affected in the later polishing step. By simulating a shape of a warp, an adequate condition for cutting can be selected, productivity and yield in a cutting process of a semiconductor silicon ingot can be improved, so that cost performance can be greatly improved.

BEST MODE FOR CARRYING OUT THE INVENTION

The embodiment of the present invention will be described below, but the present invention is not limited thereto.

Figure 1:
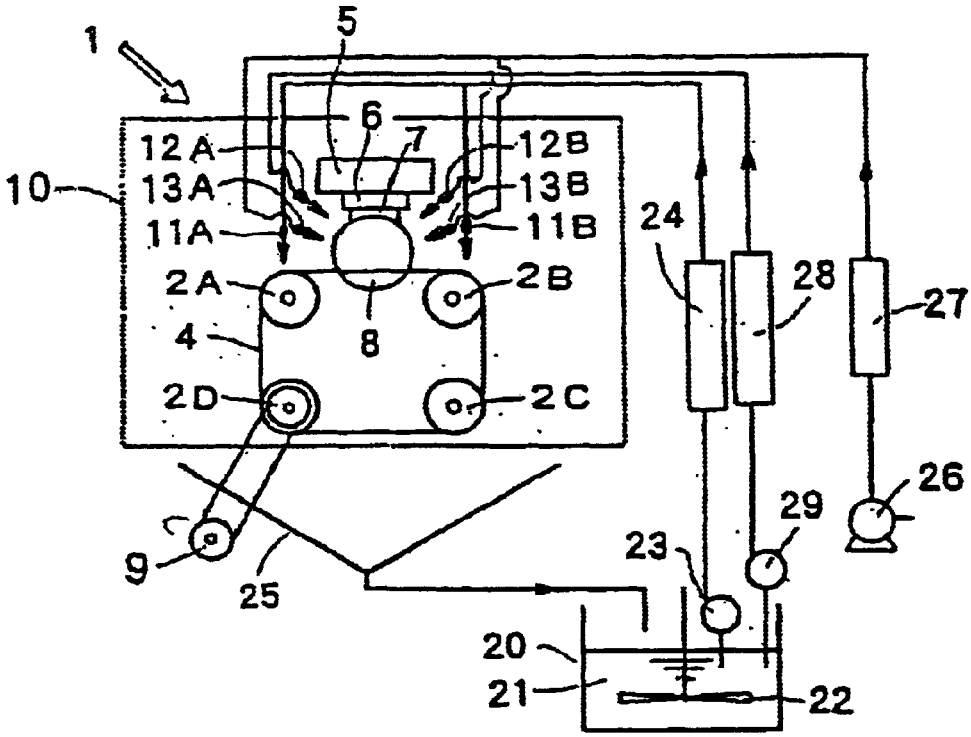
FIG. 1 is a schematic view showing an example of the wire saw of the present invention.

First, an example of the wire saw of the present invention will be explained with reference to the drawings. FIG. 1 is a schematic view showing the wire saw of the present invention.

The wire saw 1 of the present invention consists of a row of wires for cutting process formed by winding a wire 4 around four grooved rollers 2A, 2B, 2C, 2D situated in quadrilateral multiple times, a plate part 6 for positioning and fixing a work 8 on the wire 4 via a spacer 7 and a holder 5 that can move the plate 6 upward and downward, and is installed in a processing chamber 10. Nozzles for cutting fluid 11A, 11B are provided above the grooved rollers 2A, 2B to supply the cutting fluid 21 to the wire 4. The wire 4 can be reciprocated by the grooved roller 2D that is connected to a wire running means 9, and has a function of cutting the work 8 by rubbing it therewith.

The system for supplying a cutting fluid 21 consists of a pipe line system from a cutting fluid tank 20 equipped with a mixer 22 provided outside the processing chamber 10, via a temperature controlling apparatus 24, to the above-mentioned cutting fluid nozzles 11A, 11B with a pump 23, and a pipe line system via a temperature controlling apparatus 28 to a temperature controlling medium nozzles 12A, 12B. The cutting fluid 21 of which temperature is controlled is poured directly to the work 8 from the temperature controlling medium nozzles 12A, 12B in order to control the temperature of the work 8 accurately. A cutting fluid 21 used for cutting and control of the temperature as described above, is collected in a cutting fluid tank 20 via a cutting fluid receiver 25.

When the temperature of the cutting fluid supplied to the cutting fluid nozzle 11A, 11B (for a grooved roller) and the temperature of the cutting fluid supplied to the temperature controlling medium nozzles 12A, 12B (for a work) are the same, temperature controlling apparatuses 24, 28 can be in common, and the line can be separated to two lines after the temperature controlling apparatus 24 or 28.

In an embodiment of the present invention, since the temperature controlling medium supplied to the work is a cutting fluid, the cutting fluid tank 20 is also used for a cutting fluid supplied to the grooved roller. However, a tank for supplying to a grooved roller can be independent of a tank for supplying to a work, and cutting fluid can be supplied thereto separately. Particularly, when a temperature controlling medium other than a cutting fluid is supplied, such a constitution is adopted.

As another line, compressed air provided by an air compressor 26 is sprayed directly to the work 8 from air nozzles 13A, 13B, after the temperature thereof is controlled in a air temperature controlling apparatus 27, so that the temperature of the work 8 can be controlled accurately.

Cutting of the work 8 can be conducted using the above-mentioned wire saw 1 by positioning and then fixing the work 8 to a spacer 7 and a plate part 6 respectively with an adhesive, and then attached to the holder 5. Then, the holder 5 is moved downward, toward the wire 4 that is running, and the work 8 is cut by being pressed against the wire 4 on which the cutting fluid 21 is applied. During cutting, the cutting fluid 21 is also poured from the cutting fluid nozzles 11A, 11B, to the grooved roller 2A, 2B, so that it may be supplied to the cut surface, and a cutting fluid 21 is poured directly to the work 8 from the temperature controlling medium nozzle 12A, 12B to control the temperature of the work 8. Furthermore, temperature controlled air can be used as a temperature controlling medium, namely sprayed directly to the work 8 from the air nozzles 13A, 13B to control the temperature of the work 8. The temperature controlling medium is not limited to air. For example, it can be water, or any other medium.

The inventors of the present invention have found that, in order to prevent the large warp from being formed locally near the part where the cutting was started and the part where cutting was terminated of the wafer cut with a conventional wire saw, change in temperature at the beginning of cutting should be made gentle. Furthermore, they conducted simulation by modeling the condition of cutting, considering that the condition determined by simulating the shape of the warp can be applied, and found that the shape of the warp can be predicted with the following simulation.

Accordingly, the warp can be easily controlled by appropriately controlling the temperature of the work during cutting based on the result of the simulation.

Figure 2:
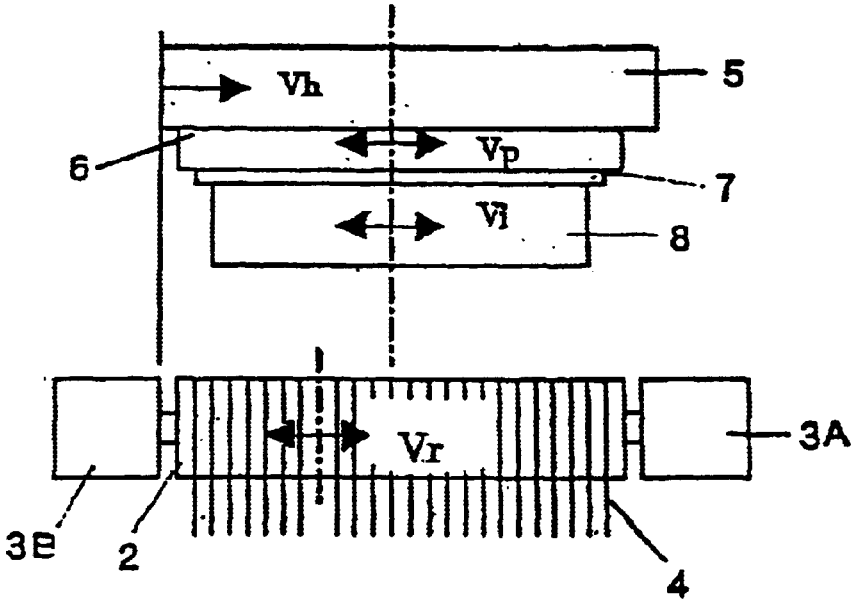
FIG. 2 PRIOR ART
FIG. 2 is a schematic view explaining a model in the case that a shape of a warp of a wafer after cutting is simulated.

It is considered that large change in the temperature of the work is formed due to friction heat during cutting of the work may lead to difference in an amount of displacement on each part of the wire saw, resulting in formation of a complex shape of the wafer. Accordingly, modeling was conducted as follows. FIG. 2 shows a schematic view for explaining the simulation. In FIG. 2, the side of the work, the side of the grooved roller of the wire saw and the like are shown. In FIG. 2, the work 8 adhered to the plate part 6 and the spacer 7 is taken in and out from the right side (occasionally referred to as the operation side) of FIG. 2. The right side is occasionally referred to as the apparatus side.

In the simulation, the amount of displacement was considered as for the work 8, the plate part 6, the grooved roller 2, and the holder 5. In order to simplify the simulation, it was assumed that linear expansion in each of the above-mentioned part occurred only in an axis direction of the work. The starting point of linear expansion was defined as a center in an axis direction as for the work and the plate part, a position of one third of whole length on the apparatus side as for the grooved roller, and the apparatus side as for the holder. These starting points were defined by experience, and were sufficiently consistent with the results of cutting. The following formula 1 is a calculation formula of displacement vector sum wherein displacement to the right of FIG. 2 (the apparatus side) is defined to be plus.

Apparatus side (plus)

$$X=Vi-Vr-Vp+Vh \quad (1)$$

wherein Vi is a vector of the work, Vr is a vector of the grooved roller, Vp is a vector of the plate part, and Vh is a vector of the holder.

And Vi is represented as follow.

$$Vi=k\cdot L\cdot \Delta t$$

wherein k is a linear expansion coefficient of the work, L is a length of the work, Δt is a difference of the temperature of the work at the beginning of the cutting and the temperature during cutting measured. Vr, Vp and Vh are also-calculated as Vi.

The test conducted in order to confirm effectiveness of the present invention will be explained below.

Test 1

A work 8 was cut according to the conventional method wherein temperature of the work was not controlled. A silicon single crystal having a diameter of 200 mm was used as the work 8, a piano wire was used as a wire 4, a mixture of abrasive grains made of SiC and a coolant liquid was used as a cutting fluid 21. The cutting fluid was poured to the grooved rollers 2A, 2B using only the grinding nozzles 11A, 11B, to cut out 200 wafers.

Figure 5:
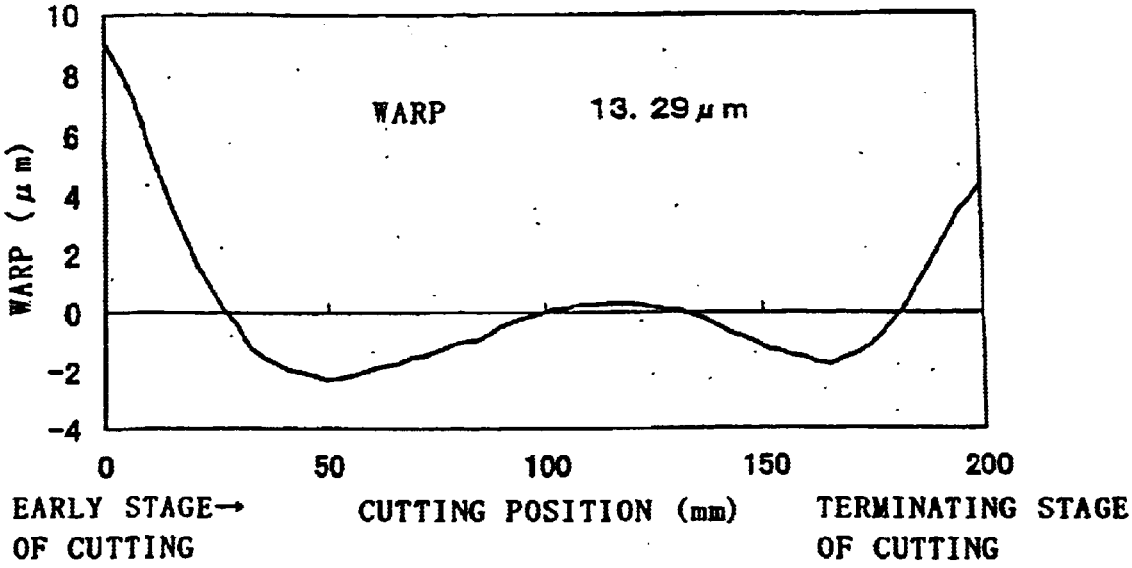
FIG. 5 PRIOR ART
FIG. 5 is a view of an example of the shape of a warp of the wafer obtained by cutting with a wire saw according to a conventional method.

The shape, of the warp of the resultant wafer was shown in FIG. 5. FIG. 5 shows a result of measurement with Auto Sort (brand name, manufactured by Tropel corporation). Generally, displacement in a wire saw is large at an edge part of an ingot or an edge part of a grooved roller. Accordingly, the warp of the wafer tends to be large at the edge of the ingot. In the test of the present invention, the warp of the wafer and the change in temperature of each part were evaluated at the edge on the operation side (the side on which the work is taken in and out, namely on the right side of FIG. 2).

As shown in FIG. 5, extreme change in shape was occurred at the part cut in the early stage of cutting, resulting in a large warp. The extreme change in the shape of the warp may degrade flatness in a polishing step.

Figure 3:
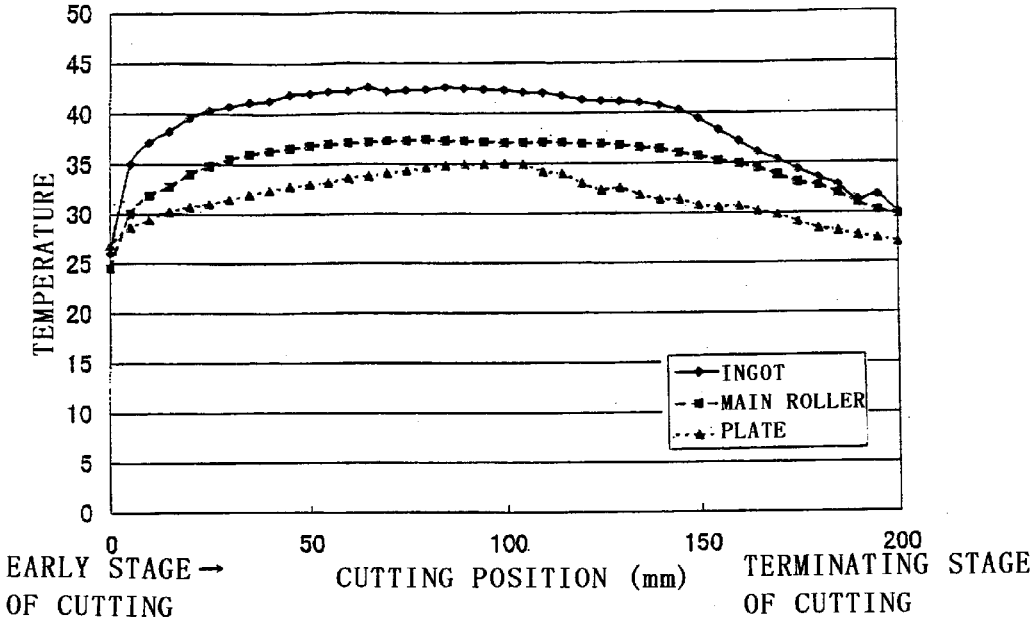
FIG. 3 is a graph showing an example of change in temperature of a work (ingot), grooved rollers (main roller), a plate part from the beginning to the end of cutting, when the cutting is conducted according to a conventional method.

Change in temperature of each of the ingot (work), a main roller (a grooved roller) and a plate part at that time was shown in FIG. 3. Although the temperature of the work was 25° C. at the beginning of cutting, it got 43° C. or more at a peak during cutting, and it sometimes got 50° C. or more. The temperature of the grooved roller increased due to transmission of the cutting heat generated between the work and the wire via the wire. However, the temperature is lower than the temperature of the work and difference of temperature was also small.

As shown in FIG. 3, a cutting area where the work is brought into contact with the wire saw is enlarged rapidly in an early stage of cutting, and an amount of heat generation is increased, change in temperature of the work is rapid. When the ingot is cut 20 mm to a direction of diameter, cutting length is 60% of a diameter of ingot (in the case of a diameter of 8 inches). Even when the ingot is further cut, a rate of increase in a cutting area is small, so that change in temperature of the work is gentle. Accordingly, it has been found in the present invention that large warp can be prevented from being formed in an early stage of cutting by directly cooling the work to suppress rapid increase in temperature of the work.

Test 2

Figure 6:
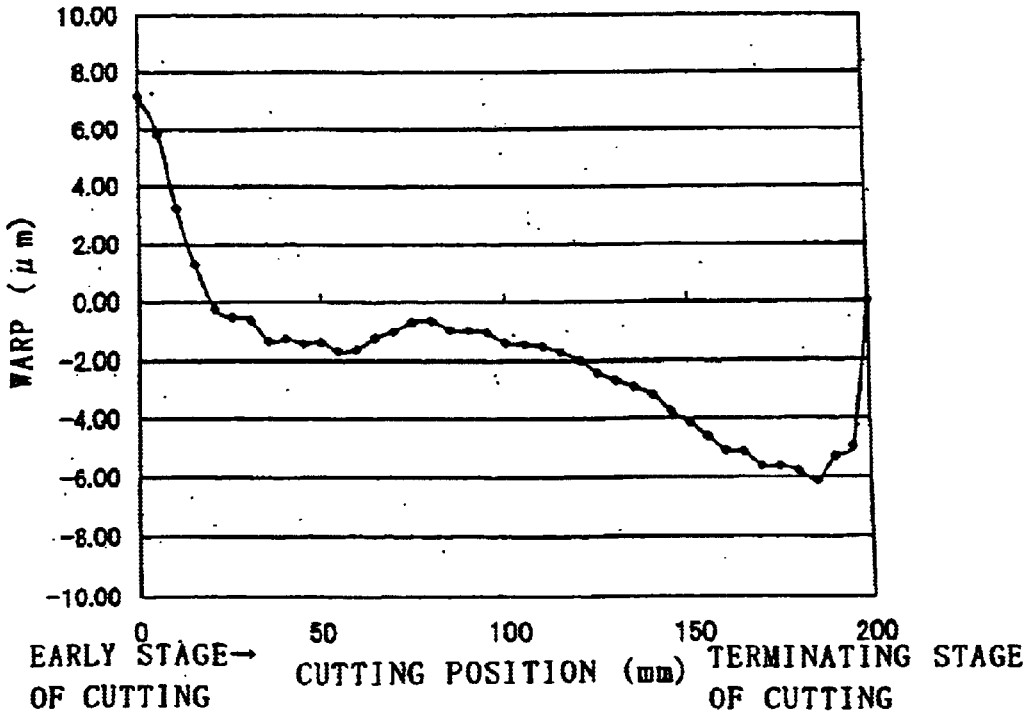
FIG. 6 is a view showing a result of simulation of the shape of a warp of the wafer obtained by cutting with a conventional wire saw using a model of FIG. 2.

Then, the simulation was confirmed as follows. The simulation of the shape of the warp was conducted with defining linear expansion coefficient of each of the work, the plate part, the grooved roller, the holder and measured change in temperature of each of the work, the plate part, the grooved roller and the holder. The solid line in FIG. 6 shows a result of the simulation. It was compared with the shape of section of the wafer actually cut in Test 1 shown in FIG. 5, and found to be well consistent therewith, as for large change of the shape in the early stage and the terminating stages of the cutting and as for the shape having a waviness around the center thereof, or the like.

Figure 8:
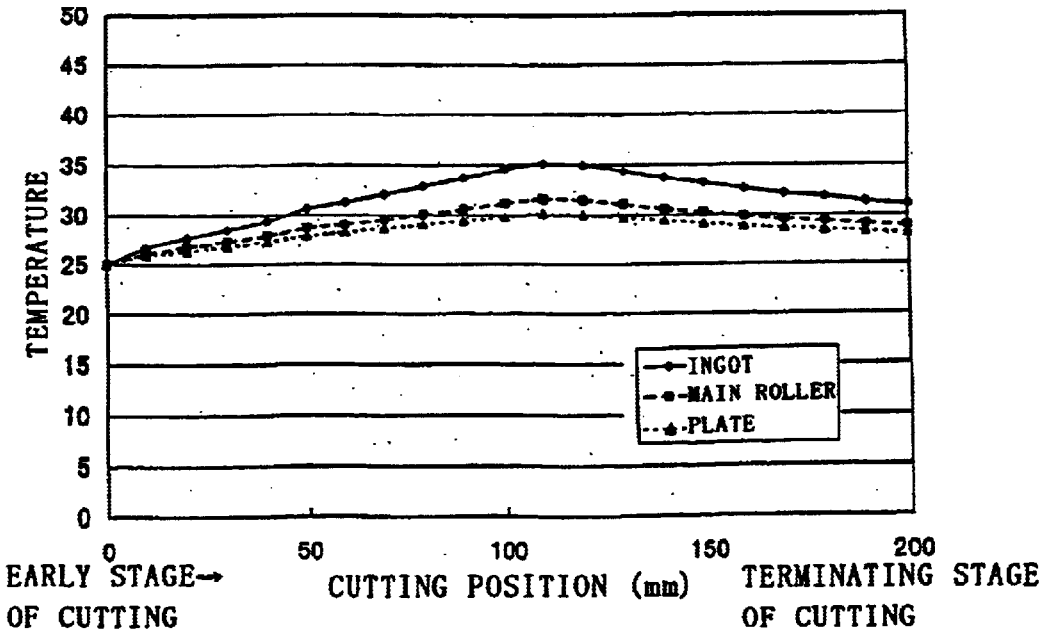
FIG. 8 is a view showing a result of simulation of cutting temperature for obtaining the wafer having high flatness and no warp.

Since it can be confirmed that the warp and the shape of the wafer can be predicted by simulation as described above, the condition for providing a flat shape was studied by the simulation. Namely, the condition for making change of the shape (warp) in the early stage of cutting small and providing a highly flat wafer. Specifically, the temperature of each part enabling the change of the shape at each cutting position of ±0.01 μm or less was predicted. The result of the simulation was shown in FIG. 8.

The result of the simulation showed that the wafer wherein the warp is flatter can be sliced when the highest temperature of the work (ingot) is controlled to be less than 35° C. In the case of the wire saw of the present invention, rapid change in the shape at the early stage and the terminating stage of cutting can be prevented by controlling the temperature as in the simulation. Furthermore, change in the shape such as a waviness or the like of the wafer can also be made small.

Accordingly, in order to make change in temperature at the early stage of cutting gentle, and to lower the highest temperature during cutting, there was adopted a method comprising providing the temperature controlling medium nozzle for pouring a temperature controlling medium temperature controlled to the work willingly, and cutting the work with pouring the medium.

Test 3

The wire saw 1 in FIG. 1 was used, and a cutting fluid was poured to the grooved roller 2A, 2B using the cutting fluid nozzles 11A, 11B, and a cutting fluid was poured to the work 8 using the temperature controlling medium nozzles 12A, 12B.

The work 8 having a diameter of 8 inches was cut with keeping a cutting fluid at a temperature of 25° C., and cooling it with pouring the cutting fluid to the work 8 from a diagonally upper direction.

At that time, the temperature of the work at the beginning of cutting was 25° C., and was increased to 43° C. at peak. Although it was not possible to keep the highest temperature less than 35° C., rapid heat generation at the beginning of cutting can be prevented almost completely.

Figure 4:
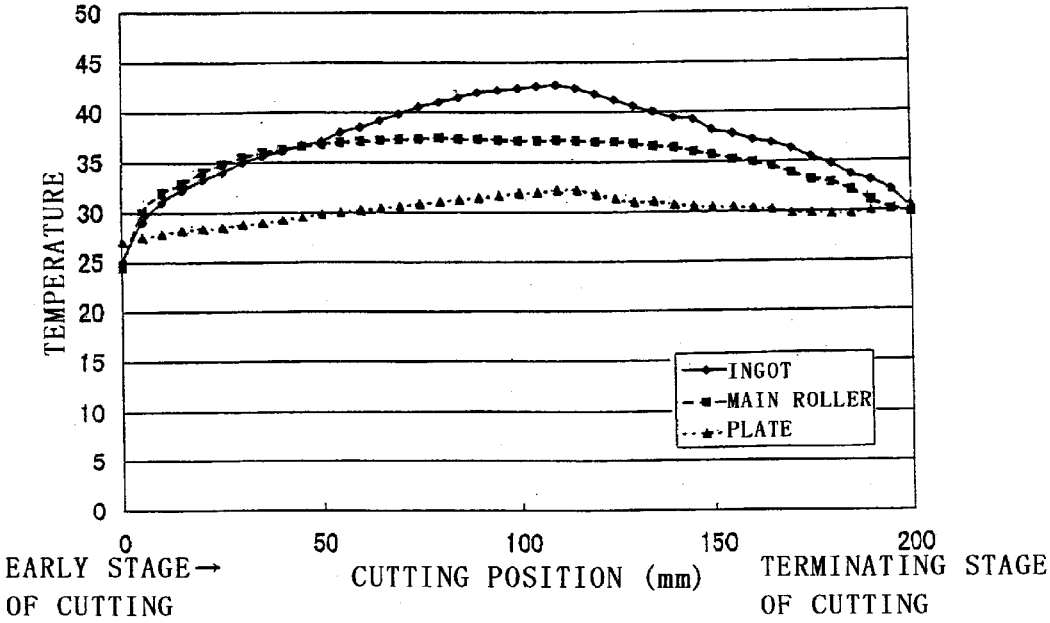
FIG. 4 is a graph showing an example of change in temperature of a work, grooved rollers, a plate part from the beginning to the end of cutting, when the cutting is conducted according to the method of the present invention.

The change in temperature during cutting was shown in FIG. 4. As shown in FIG. 4, change in temperature of the work (ingot) from the beginning of cutting to the time at which it was cut to 20 mm in a direction of a diameter can be controlled to be 10° C. or less. Particularly, the change to the time at which the work is cut to 10 mm could be made gentle. The shape of the warp of the wafer obtained by the cutting was shown in FIG. 7. It has been found that extreme change of the shape in the early stage of cutting can be prevented, and the method of directly cooling the work with a cutting fluid that is a temperature controlling medium is quite effective. Since a sufficient amount of the cutting fluid cannot be supplied to the cutting position only by pouring the cutting fluid directly to the work, the cutting fluid was also supplied to the grooved roller. Thereby, the sufficient amount of the cutting fluid can be supplied to the cutting position, and change in temperature of the grooved roller itself can be controlled.

Test 4

The wire saw 1 in FIG. 1 was used, and a cutting fluid was supplied to the wire with the cutting fluid nozzles 11A, 11B, and an air was supplied to the work with the air nozzles 13A, 13B.

The cutting fluid was kept at a temperature of 25° C., and poured to the grooved rollers 2A, 2B. The air was kept at a temperature of 25° C., and directly sprayed to the work 8 having a diameter of 8 inches from a diagonally upper direction, so that the work 8 was cut with cooling.

At that time, the temperature of the work at the beginning of cutting was 25° C., and was increased to 48° C. at peak. However, rapid heat generation at the beginning of cutting can be prevented almost completely.

Figure 7:
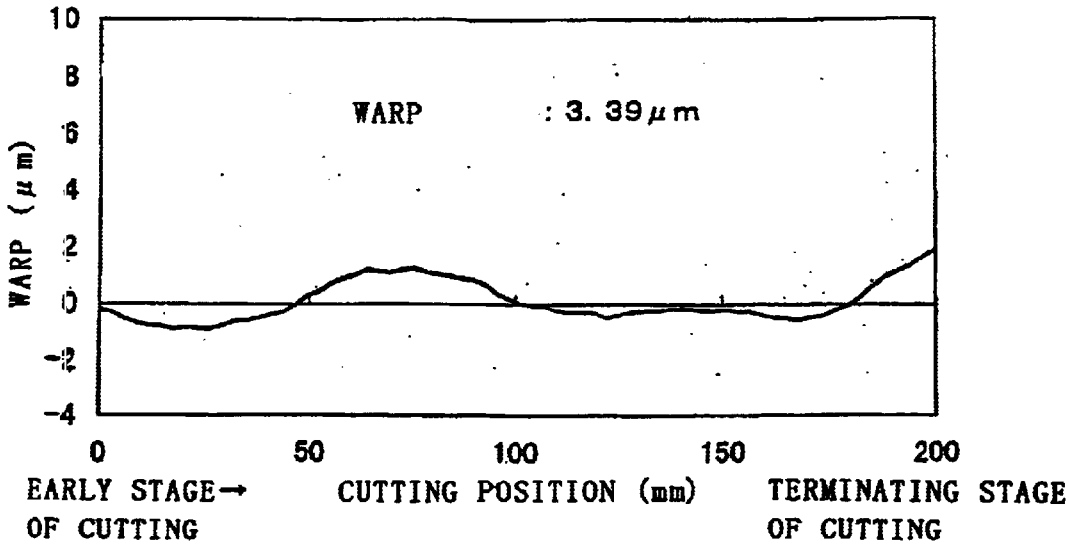
FIG. 7 is a view of an example of the shape of a warp of the wafer obtained by cutting with a wire saw according to the method of the present invention.

The shape of the warp of the wafer obtained by the cutting was approximately the same as the shape of the wafer obtained in Test 3 (See FIG. 7). It has been found that extreme change of the shape in the early stage of cutting can be prevented, and the method of cooling with air is also effective. Change in temperature of the work from the beginning of cutting to the time at which it was cut to 20 mm in a direction of a diameter could also be controlled to be 10° C. or less.

Test 5

The method of heating the work was tested. The peak temperature of the work during cutting of 45° C. obtained by the conventional method of Test 1 was defined as the predetermined temperature of the work that had been previously defined.

The wire saw shown in FIG. 1 was used, and the temperature controlling medium nozzles 12A, 12B was used together with the cutting fluid nozzles 11A, 11B.

The work was previously heated to about 45° C. by oven, before the work was set on the wire saw, and then the work was set on the wire saw. Then, it was heated to 45° C. with a heater provided at the plate part, the cutting fluid of which temperature was controlled to be 25° C. was supplied to the grooved rollers 2A, 2B and also poured directly to the work 8 from a diagonally upper direction, and then cutting was initiated.

At that time, the temperature of the work at the beginning of cutting was 47° C., and was increased to 52° C. at peak. However, change in temperature during cutting can be made small. The shape of the warp of the wafer obtained by the cutting was approximately the same as the shape of the wafer obtained in FIG. 7 of Test 3. There was no extreme change of the shape in the early stage or the terminating stage of cutting.

From the results of the simulation, it has been found that the better warp can be produced by controlling whole change in temperature of the work from the beginning to the end of cutting to be 10° C. or less. Namely, if the work was cut with controlling the highest temperature during cutting may be less than 35° C. that is 10° C. higher than 25° C. that is a temperature before cutting by pouring the cutting fluid and the cooled air, the wafer having somewhat smaller warp than that of Test 3 shown in FIG. 7 could be obtained, and it was well consistent with the tendency of the simulation although completely the same control as the temperature distribution in the simulation cannot be achieved.

As described above, if the temperature of the work is controlled by cooling the whole of the work to the predetermined temperature directly with the temperature controlling medium or by preheating the work, particularly so that change in temperature at the early stage may be gentle, difference in heat expansion between the work and the wire saw can be made small, and the extreme change of the shape in the early stage of cutting can be prevented, the warp can be made small. As a result, the wafer having a desired shape of the warp can be sliced out. Furthermore, an appropriate condition for cutting can be selected by simulating the shape of the warp.

Another means for controlling willingly can be a temperature controlling means provided at a plate part supporting the work. The temperature of the work during cutting can also be controlled accurately thereby.

The present invention is not limited to the above-described embodiment. The above-described embodiment is a mere example, and those having the substantially same structure as technical idea that described in the appended claims and providing the similar action and effects are included in the scope of the present invention.

For example, in the above-mentioned embodiment of the present invention, the silicon wafer having a diameter of 200 mm (8 inches) was sliced. However, the present invention can also be applied to the recent larger wafer having a diameter of 250 mm (10 inches)—400 mm (16 inches) or more.

The wire saw having four grooved rollers was used in the above embodiment. However, the another type of the wire saw can be used. Specifically, the similar effect can be achieved in the wire saw having three or two grooved rollers.

What is claimed is:

1. A cutting method comprising winding a wire around plural grooved rollers, and pressing the wire against the work with running it, to cut the work, wherein the work is preheated at a predetermined temperature, and the work is cut with supplying a cutting fluid containing abrasive grains to the grooved rollers, wherein change in temperature of the work in at least one of a period from the beginning of the cutting process to the time when a cutting length reaches 60% of a diameter of the work and a period from the time when a cutting length reaches 60% of a diameter of the work to the end of the cutting process in the latter half of the cutting is controlled to be 10° C. or less.

2. A cutting method comprising winding a wire around plural grooved rollers, and pressing the wire against the work with running it, to cut the work wherein the work is preheated at a predetermined temperature, and the work is cut with controlling a temperature of the work by supplying a cutting fluid to the grooved rollers, and supplying a temperature controlling medium to the work, wherein change in temperature of the work in at least one of a period from the beginning of the cutting process to the time when a cutting length reaches 60% of a diameter of the work and a period from the time when a cutting length reaches 60% of a diameter of the work to the end of the cutting process in the latter half of the cutting is controlled to be 10° C. or less.

3. The cutting method according to claim 1 wherein the temperature of the work can be predetermined so that a shape of the warp of the wafer defined by simulation with coefficient of linear expansion and temperature of each part of the work and the wire saw can be flat.

4. The cutting method according to claim 2 wherein the temperature of the work can be predetermined so that a shape of the warp of the wafer defined by simulation with coefficient of linear expansion and temperature of each part of the work and the wire saw can be flat.

5. The cutting method according to claim 2 wherein the temperature controlling medium is at least one of a cutting fluid of which temperature is controlled and an air of which temperature is controlled.

6. The cutting method according to claim 1 wherein the temperature of the work during cutting is kept lower than 35° C.

7. The cutting method according to claim 2 wherein the temperature of the work during cutting is kept lower than 35° C.

8. The cutting method according to claim 1 wherein the temperature of a plate part for supporting the work is controlled.

9. The cutting method according to claim 2 wherein the temperature of a plate part for supporting the work is controlled.

* * * * *